United States Patent [19]

Brockington

[11] 4,218,272

[45] Aug. 19, 1980

[54] WATER-IN-OIL NCN EMULSION BLASTING AGENT

[75] Inventor: James W. Brockington, Allentown, Pa.

[73] Assignee: Atlas Powder Company, Dallas, Tex.

[21] Appl. No.: 966,144

[22] Filed: Dec. 4, 1978

[51] Int. Cl.[2] ..... C06B 45/02

[52] U.S. Cl. ..... 149/21; 149/2; 149/43; 149/44; 149/46; 102/23

[58] Field of Search ..... 149/2, 46, 21, 44, 60, 149/43; 102/23

[56] References Cited

U.S. PATENT DOCUMENTS

| | | | |
|---|---|---|---|
| 4,104,092 | 8/1978 | Mullay | 149/60 X |
| 4,110,134 | 8/1978 | Wade | 149/60 X |
| 4,138,281 | 2/1979 | Olney et al. | 149/46 X |

*Primary Examiner*—Stephen J. Lechert, Jr.
*Attorney, Agent, or Firm*—Richards, Harris & Medlock

[57] ABSTRACT

Water-in-oil emulsion blasting agent compositions are provided which are non-cap sensitive yet detonable under high heads of water and which contain as the sole oxidizing salt ammonium nitrate, an ammonium nitrate to hydrocarbon fuel weight ratio in the range of about 95:5 to about 93:7, a preferred wax to oil weight ratio in the range of from about 1:1 to about 1:4, void containing material to yield a final density at the time of manufacture of from about 1.20 to about 1.25 grams per cubic centimeter and optionally up to about 12 parts by weight of auxiliary fuel per 88 parts of the above composition. The blasting agents are capable of cartridge-to-cartridge propagation even when detonated under high heads of water when packaged in cardboard containers.

27 Claims, No Drawings

WATER-IN-OIL NCN EMULSION BLASTING AGENT

BACKGROUND OF THE INVENTION

This invention relates to water-in-oil emulsion blasting agent compositions having a single oxidizer salt. In another aspect, this invention relates to a water-in-oil emulsion blasting agent composition which is detonable under high heads of water and will propagate in rigid paper containers once detonated under such high heads of water. In still another aspect, this invention relates to an emulsion blasting agent which is inexpensive, powerful, simple to manufacture and resistant to sensitivity losses from impact that occur, for example, during shipment, even in extreme weather conditions.

In the past, there existed a need for a reliable and inexpensive nitro-carbo-nitrate (NCN) blasting agent that would function in wet boreholes under high heads of water. Previously the common practice was to use a packaged high density ammonium nitrate fuel oil (ANFO) blasting agent. Underwater use of the packaged ANFO often resulted in poor performance. Moreover, a suitable slurry product or emulsion that would meet the aforesaid requirements was not available. Bluhm, in U.S. Pat. No. 3,447,978, first disclosed use of water-in-oil emulsion type blasting agents. The emulsion blasting agents disclosed by Bluhm contain an aqueous solution of inorganic oxidizer salt that is emulsified as the dispersed phase within a continuous carbonaceous fuel phase, and a uniformly distributed gaseous component. These blasting agents require air for sensitization and possess poor water pressure tolerance. Bluhm basically relied on the presence of an occluded air phase or the addition of microbubbles to sensitize the blasting agent.

Wade, in U.S. Pat. No. 4,110,134, disclosed cap sensitive water-in-oil emulsion explosives using glass microspheres. Wade disclosed that there was a maximum detonation density of the explosive composition over which the composition would not be cap sensitive. The maximum detonation density was further disclosed to be a function of the amount of water, the type of oxidizer, and the amount of oil present in a composition. Wade did not teach or disclose a composition which would be non-cap sensitive and possess high water pressure tolerance.

Tomic, in U.S. Pat. No. 3,770,522, discloses that a water-in-oil emulsion can be formed of an aqueous solution of an inorganic oxidizing salt, a water insoluble carbonaceous fuel, a gas sensitizer which may be either occluded air bubbles or microballoons and a stearate salt selected from the class consisting of ammonium and alkali metal stearates as an emulsifier. Tomic asserts that the presence of the stearate salt causes the emulsion to have improved properties of water compatibility and pumpability and non-adherence to walls of packages.

Thornton, in U.S. Pat. No. 3,442,727, discloses a non-cap sensitive blasting agent which contains an aqueous phase of nitric acid and which can contain some oxidizer salts such as ammonium nitrate and a mono or di ester of phosphoric acid or a salt thereof used as an emulsifier for the nitric acid. Thornton does disclose that the composition can contain occluded air or gas imparting materials such as expanded perlite or hollow glass balls.

Cattermole, et al. in U.S. Pat. No. Re. 28,060, teaches that the addition of certain amine nitrate compounds to water-in-oil emulsion blasting agent compositions will assure that once such compositions are detonated, the explosion will propagate in a two or three-inch borehole.

Wade, in U.S. Pat. Nos. 3,715,247 and 3,765,964, discloses that water-in-oil emulsion explosive compositions can be prepared which retain all the advantages of the emulsion blasting agents but are cap-sensitive without the use of explosive ingredients. These two references disclose that such emulsion blasting agents can be rendered cap-sensitive by the addition of a detonation sensitizer or catalyst such as an inorganic metal compound of atomic number 13 or greater and strontium compounds.

Thus, heretofore a nitro-carbo-nitrate emulsion blasting agent having the capability of being detonable under high heads of water, the capability of propagating end-to-end in cardboard containers under high heads of water and having resistance to sensitivity losses from impact that occur, for example, during shipment, even in extreme weather conditions, was unavailable.

SUMMARY OF THE INVENTION

According to the invention, water-in-oil emulsion NCN blasting agents are provided having a simple formula allowing for ease of manufacture and high water pressure tolerance. The NCN water-in-oil emulsion blasting agent of this invention consists essentially of from about 75.5% to about 77.5% ammonium nitrate, from about 14.0% to about 18.0% water, from about 0.7% to about 2.0% of an emulsifier, from about 0.95% to about 2.2% of a wax, from about 2.0% to about 4.0% of an oil, and sufficient void containing material to yield a density in the final composition at the time of manufacturing of from about 1.20 to about 1.25 grams per cubic centimeter. Generally, upon aging, the emulsion will increase in density and the final composition will have a density of greater than about 1.20 but no more than about 1.35. To the above composition an auxiliary fuel may be optionally added, such as particulate aluminum in an amount up to about 12 parts of auxiliary fuel per 88 parts of the above composition, but generally up to about 4 parts of auxiliary fuel per 96 parts of the above composition. In the most the preferred embodiment, the ratio of wax to oil is about 1:3. The composition is preferably packaged in rigid paper shells or in film packages. The emulsion blasting agent composition of the invention results in unexpected beneficial properties, for example, the capability of being detonated under high heads of water, the capability of cartridge-to-cartridge propagation under high heads of water when packaged in cardboard containers and increased sensitivity and resistance to sensitivity losses due to impact occurring, for example, from transportation of the blasting agent, even during extreme weather conditions.

DETAILED DESCRIPTION OF THE INVENTION

The composition of the present invention has an aqueous solution component having ammonium nitrate and water which forms a discontinuous aqueous phase and a continuous phase of carbonaceous fuel, having wax, oil and emulsifier. The water-in-oil blasting agent compositions of the invention detonate under high heads (up to 180 feet) of water, propagate underwater when packaged in cardboard containers, even after being subjected to conditions that occur, for example, during transportation in extreme weather conditions.

Ammonium nitrate is the oxidizing salt used in the blasting agent composition of the present invention and is present in amounts of from about 75.5% by weight of the total composition and preferably from about 75.76% to about 77.42% by weight of the total composition, and more preferably about 76.85% by weight of the total composition. No other oxidizer salt is used in the composition according to the invention. Use of ammonium nitrate as a single oxidizer salt in accordance with the invention results in unexpected sensitivity. Generally, oxidizing salts such as sodium perchlorate, sodium nitrate, or a combination of those oxidizer salts with ammonium nitrate are thought to provide better sensitivity than when only ammonium nitrate is used as the oxidizer. The blasting agent emulsion of the present invention, using only ammonium nitrate as the oxidizer, is sensitive enough to propagate underwater when packaged in cardboard cylindrical containers having a wall thickness for example between about 1/16" to about ⅛".

The amount of water of the total composition is from about 14.0% to about 18.0% by weight and preferably from about 14.20% to about 17.78% by weight and most preferably about 15.74% by weight of the total composition. Thus, the composition can be formulated using an aqueous 83% ammonium nitrate solution as the oxidizer solution. This simplifies the manufacture of the composition because the 83% ammonium nitrate solution is a standard commercial product readily obtainable and therefore results in a lower cost of the final product.

An emulsifying agent in the composition ranges from about 0.7% to about 2% by weight of the total composition. Preferably, the emulsifier is present in an amount of about 1% by weight of the total composition. The emulsifier is a water-in-oil emulsifier such as those derived from sorbitol by esterification with removal of one molecule of water, such as sorbitan fatty acid esters, sorbitan monolaurate, sorbitan monooleate, sorbitan monopalmitate, sorbitan monostearate, and sorbitan tristearate. Other useful materials comprise mono and diglycerides of fat forming fatty acids, as well as polyoxyethylene sorbitol esters, such as polyethylene sorbitol beeswax derivative materials, polyoxyethylene (4) lauyrl ether, polyoxyethylene (2) ether, polyoxyethylene (2) stearyl ether, polyoxyalkylene oleate, polyoxyalkylene laureate, oleyl acid phosphate, substituted oxazolines and phosphate esters, mixtures thereof and the like. A preferred emulsifier is Glycomul "O" which is a sorbitan monooleate emulsifier sold by Glyco Chemicals, Inc.

According to the invention, a specific ratio of wax to oil in the composition is required to prevent cartridge-to-cartridge propagation failures and provide stability to the product. For example, the wax to oil ratio disclosed reduces sensitivity losses which may occur when the composition is utilized in cold environments. According to the invention, the ratio of wax to oil should preferably be in the range of from about 1:1 to about 1:4 on a weight basis. In the most preferred embodiment, the ratio of wax to oil is about 1:3 on a weight basis. Previous formulations, such as those disclosed by Wade in U.S. Pat. No. 4,110,134, contained preferred wax to oil ratios of approximately 3:1. Thus, it would not be expected that the preferred wax to oil ratios disclosed herein would increase sensitivity and reduce sensitivity loss caused by impact that may occur, for example, during transportation, shipment or during usage, such as dropping the blasting agent. Failure to maintain the wax to oil ratio according to the invention can result in loss of sensitivity and failure to propagate underwater when placed end to end in cardboard containers, when the container is subjected to simulated transportation conditions, as shown in subsequent examples.

The wax content should range from about 0.95% to about 2.2% by weight and preferably from about 0.98% to about 2.11% by weight of the total composition, while in the most preferred composition about 1.24% by weight of the total composition is a wax. Suitable waxes which can be used in accordance with the present invention are those having melting points of at least 80° F., such as petrolatum wax, microcrystalline wax and paraffin wax; mineral waxes such as ozocerite and montan wax; animal waxes such as spermacetic; and insect waxes such as beeswax and Chinese wax. Preferred waxes are Witco X145-A and Aristo 143° both marketed by Witco Chemical Company. The most preferred waxes are a blend of Witco X145A wax and Aristo 143° wax. Other waxes include Indra 1153, Indra 5055-G, Indra 4350-E, Indra 2126-E and Indra 2119 sold by Industrial Raw Materials Corporation, and a similar wax sold by Mobil Oil Corporation under the trade designation Mobil 150.

The water-in-oil blasting agent, according to the invention, should contain from about 2.0% to about 4.0% by weight and preferably from about 2.11% to about 3.92% by weight of an oil in the total composition. The oil content is about 3.68% by weight in the total composition in the most preferred embodiment. Suitable oils include the various petroleum oils, vegetable oils, and various grades of dinitrotoluene. The preferred oil is a white mineral oil sold by Witco Chemical Company, Inc. under the trade designation Kaydol, while another specific mineral oil which can be used is sold by Atlantic Refining Company under the trade designation Atreol.

The blasting agent of the subject invention is preferably made utilizing an aqueous solution of ammonium nitrate having an ammonium nitrate concentration in the range of from about 81% by weight to about 84.5% by weight and most preferably 83% by weight. The oxidizer to fuel weight ratio (fuel being total weight of the wax, oil and emulsifier used) is in the range of from 95:5 to about 93:7 and preferably about 94:6. The wax to oil weight ratio in the composition is no more than 1:1 and generally in the range of from 1:1 to about 1:4 and most preferably 1:3. However, the wax to oil ratio may be as low as about 1:10.

Sufficient void containing material is added to the emulsion composition of the subject invention to yield a density at manufacturing of from about 1.20 to about 1.25 grams per cubic centimeter. The preferred density of the subject invention is about 1.23 grams per cubic centimeter at the time of manufacturing. Thus, the blasting agents of the present invention will settle when dropped into water. Glass microbubbles having a particle size within the range of about 10 to about 175 microns are the preferred closed cell void containing materials to be utilized within the scope of the subject invention. The most preferred microbubbles are those sold by PQ Corporation under the trade designation Q-CEL-200. Other microbubbles which can be utilized within the scope of the subject invention are the microbubbles sold by 3M company and which have a particle size distribution in the range of from about 10 to about 160 microns and the nominal size in the range of about 60 to 70 microns, and densities in the range of from about 0.1 to about 0.4 grams per cubic centimeter.

To the total composition (ammonium nitrate, water, oil, wax, emulsifier and void containing material) may be added an auxiliary fuel. The weight percentages previously set forth assume there is no auxiliary fuel present. If an auxiliary fuel is present, those weight percentages will be reduced. For example, if it is desired for a final composition to contain 3% of an auxiliary fuel with the preferred amount of ammonium nitrate, which is about 76.85% by weight without an auxiliary fuel, the weight percent of ammonium nitrate in the final composition will be (76.85%)×(1.00–0.03) or 74.54%. Similarly, the weight percentages of the other components will be reduced by a similar factor by the addition of the auxiliary fuel. The auxiliary fuel may be present in an amount of up to 12% by weight of the final composition, which is the total composition plus the auxiliary fuel, or 12 parts of auxiliary fuel per 88 parts of total composition. The preferred auxiliary fuel is particulate aluminum, although other materials, such as aluminum alloys, magnesium and the like may be used.

The NCN blasting agent emulsions of this invention can be manufactured by forming a premix of the wax, oil and emulsifier and blending that premix with a commercial aqueous solution of 83% ammonium nitrate. Generally, the aqueous ammonium nitrate solution is heated until the ammonium nitrate is completely dissolved (about 120° to 205° F.), and the carbonaceous fuel premix is also heated until liquified. Glass microbubbles are added until the density of the resulting mixture formed by mixing the carbonaceous fuel premix and the aqueous ammonium nitrate solution is lowered to the required range. The final emulsion is then packaged in containers of the desired configuration. For example, the emulsion blasting agents can be packaged in film or the emulsion may be packaged in cardboard or rigid paper laminated cartridges which are either wound or convoluted containers having a thickness of from about 1/16 inch to about ⅛ inch. The cartridge should have a diameter of at least about 1.5 inches. The cardboard container is typically crimped at the bottom and top ends and also taped at the top. The use of a cardboard container facilitates loading of the explosive into boreholes, for example. The rigidity of the cardboard container allows it to be tamped into place without distorting and without the explosive conforming to the shape of the borehole. Other types of cardboard tubes may be used for packaging the emulsion and the emulsion may also be packaged in a film container, such as polyethylene.

The NCN water-in-oil emulsions of the subject invention are capable of being detonated under high water pressure (greater than 180 feet of water) and will propagate end to end in cardboard containers. The emulsions of the subject invention maintain this sensitivity even when subjected to impact that may occur, for example, during transportation, even under extreme weather conditions. These emulsions can be packaged in film or rigid paper or cardboard shells, are inexpensive, and also have a simple formula and are simple to manufacture.

The invention can be further understood by reference to the following examples:

EXAMPLE 1

| Ingredient | Percent by Weight Formula I | Formula II |
|---|---|---|
| Ammonium Nitrate | 76.85 | 76.85 |
| Water | 15.74 | 15.74 |
| Aristo 143° Wax | 1.84 | 0.62 |
| Witco X145A Wax | 1.84 | 0.62 |
| Kaydol Oil | 1.24 | 3.68 |
| Glycomul "O"[1] | 0.99 | 0.99 |
| Q-Cel-200 Glass Microbubbles | 1.50 | 1.50 |

[1]Emulsifier manufactured by Glyco Chemicals, Inc.

The composition of Formula II is in accordance with the invention. Formula I is similar to Formula II except for the ratio of wax to oil in Formula I was approximately 3:1, which is not within the scope of the invention. Formula II contains the preferred wax to oil ratio of 1:3. Each of the two formulas was packaged in cardboard shells 3" in diameter and 16" in length. Cartridge-to-cartridge propagation tests were conducted both with and without subjecting the packaged formulas to conditions which simulated cold weather transportion.

In the cartridge-to-cartridge propagation test the first cartridge was primed and the velocity of the second cartridge was measured with the following test results:

| Composition | Test Results: Subjected to Cold Weather Impact Conditions | Primer[1] | Detonation Velocity[2] |
|---|---|---|---|
| 1. Formula I | No | 1 Giant Booster | 19,380 |
| 2. Formula I | Yes | 1 Giant Booster | Failed |
| 3. Formula II | No | 1 Giant Booster | 18,870 |
| 4. Formula II | Yes | 1 Giant Booster | 17,860 |
| 5. Formula II | Yes (Repeat of 4.) | 1 Giant Booster | 18,520 |

[1]1 Giant Booster equals about 18-20 gm. PETN.
[2]Detonation Velocity in feet per second The test results illustrate the excellent cartridge-to-cartridge propagation of Formula II, containing the preferred wax to oil ratio and composition according to the invention. Formula I, with a wax to oil ratio not in accordance with the teaching of the invention lost sensitivity and failed to detonate when subjected to conditions simulating cold weather rough handling conditions.

EXAMPLE 2

Underwater borehole tests were conducted using the formulations of Example 1. The tests were conducted by loading a borehole with eight cartridges of one formulation. Cartridge 1 was at the bottom with a primer beneath it. Another primer with a later delay was located between cartridges 4 and 5. The detonation velocities of cartridges 1, 4, 5 and 8 were measured. Prior to loading, the cartridges were subjected to conditions simultating cold weather transportation conditions. The following test results were obtained:

| | Test Results: Formula I | Formula II | Formula II |
|---|---|---|---|
| Borehole Diameter (inches) | 6¾ | 6¾ | 6¾ |

-continued

| | Test Results | | |
|---|---|---|---|
| | Formula I | Formula II | Formula II |
| Borehole Depth (feet) | 49 | 52 | 89 |
| Water Depth After Loading (feet) | 39 | 33 | 36 |
| Detonation Velocity (feet per second) | | | |
| Cartridge 1 | Failed | 19,230 | 21,276 |
| Cartridge 4 | Failed | Shorted Start | 19,607 |
| Cartridge 5 | Failed | 19,230 | 20,000 |
| Cartridge 8 | Failed | 18,500 | 18,510 |

As in Example 1, the results indicate the advantageous underwater cartridge-to-cartridge propagation of the blasting agent composition after being subjected to simulated cold weather rough handling conditions, and the loss of sensitivity and failure to detonate underwater of a composition not having the oil to wax ratio according to the invention.

While this invention has been described in relation to its preferred embodiments, it is to be understood that various modifications thereof will be apparent to those of ordinary skill in the art upon reading this specification and it is intended to cover all such modifications as fall within the scope of the appended claims.

What is claimed is:

1. A water-in-oil emulsion blasting agent composition having a single oxidizer that propagates under water consisting of:

(a) a continuous phase of carbonaceous fuel;

(b) a discontinuous aqueous phase containing ammonium nitrate as the only oxidizer with the aqueous phase present in a ratio of aqueous phase to fuel in the range of from about 95:5 to about 93:7 by weight thereof;

(c) from about 0.7% to about 2% of an emulsifier by weight thereof;

(d) from about 2.0% to about 4.0% of an oil by weight thereof;

(e) wax present in the composition in a ratio of wax to oil of no more than about 1:1 by weight; and (f) sufficient closed cell void containing material to yield a density of said blasting agent of from about 1.20 grams per cubic centimeter to about 1.35 grams per cubic centimeter.

2. The water-in-oil emulsion composition as recited in claim 1 wherein from about 75.5% to about 77.5% by weight thereof is ammonium nitrate.

3. The water-in-oil emulsion composition as recited in claim 1 wherein from about 14.0% to about 18.0% by weight thereof is water.

4. The water-in-oil emulsion composition as recited in claim 1 wherein the ratio of ammonium nitrate to water is from about 81.0:19 to about 84.5:15.5 by weight.

5. The water-in-oil emulsion composition as recited in claim 1 wherein the weight ratio of ammonium nitrate to water is about 83:17 by weight.

6. The water-in-oil emulsion composition as recited in claim 1 wherein the ratio of wax to oil is between about 1:1 and about 1:10 by weight.

7. The water-in-oil emulsion composition as recited in claim 1 wherein the ratio of wax to oil is between about 1:1 and about 1:4 by weight.

8. The water-in-oil composition so recited in claim 1 wherein the ratio of wax to oil is about 1:3 by weight.

9. The water-in-oil emulsion composition as recited in claim 7 wherein from about 0.95% to about 2.2% by weight thereof is wax.

10. The water-in-oil emulsion composition as recited in claim 1 further consisting of up to about 12 parts of an auxiliary fuel per 88 parts of said composition by weight.

11. The water-in-oil emulsion composition as recited in claim 10 wherein the auxiliary fuel is particulate aluminum.

12. The water-in-oil emulsion composition as recited in claim 1 wherein the ratio of ammonium nitrate and water to the carbonaceous fuel is about 94:6 by weight.

13. The water-in-oil emulsion composition as recited in claim 7 wherein:

(a) from about 75.76% to about 77.42% by weight thereof is ammonium nitrate;

(b) from about 14.20% to about 17.78% by weight thereof is water;

(c) the ratio of ammonium nitrate to water is from about 81.0:19.0 to about 84.5:15.5 by weight; and (d) from about 0.98% to about 2.11% by weight thereof is wax.

14. The water-in-oil emulsion composition as recited in claim 13 wherein the ratio of wax to oil is about 1:3 by weight.

15. The water-in-oil emulsion composition as recited in claim 13 wherein about 1.0% by weight thereof is emulsifier.

16. The water-in-oil emulsion composition as recited in claim 13 further consisting of up to 12 parts particulate aluminum per 88 parts of said composition by weight.

17. The water-in-oil emulsion composition as recited in claim 1 wherein:

(a) about 76.85% by weight thereof is ammonium nitrate;

(b) about 15.74% by weight thereof is water;

(c) about 1.24% by weight thereof is a wax;

(d) about 3.68% by weight thereof is an oil;

(e) about 0.99% by weight thereof is an emulsifier; and (f) about 1.50% by weight thereof is glass microbubbles.

18. The water-in-oil emulsion composition as recited in claim 11 wherein:

(a) about 74.54% by weight thereof is ammonium nitrate;

(b) about 15.27% by weight thereof is water;

(c) about 1.20% by weight thereof is a wax;

(d) about 3.57% by weight thereof is oil;

(e) about 0.96% by weight thereof is an emulsifier;

(f) about 3.0% by weight thereof is particulate aluminum; and (g) about 1.46% by weight thereof is glass microbubbles.

19. The water-in-oil emulsion composition as recited in claim 13 wherein the density of the composition is about 1.23 grams per cubic centimeter.

20. The water-in-oil emulsion composition as recited in claim 1 wherein said composition is packaged and detonatable in cardboard shells.

21. A method of underwater detonation which comprises:

(a) providing a water-in-oil emulsion blasting agent composition, in a spiral wound cardboard cylindrical container having a thickness of from about 1/16 inch to about ⅛ inch, said composition having a continuous phase of carbonaceous fuel, a discontinuous aqueous phase containing only one oxidizer, which is ammonium nitrate, with the aqueous phase present in a ratio of aqueous phase to carbonaceous fuel in the range of from about 95:5 to about 93:7 by weight thereof, from about 0.7% to about 2.0% of emulsifier by weight of the composition thereof, from about 2.0% to about 4.0% of oil by weight of the composition thereof, wax present in the composition in a ratio of wax to oil in the range of from about 1:1 to about 1:4 by weight thereof, and sufficient closed cell void containing material to yield a density of said blasting agent from about 1.20 grams per cubic centimeter to about 1.35 grams per cubic centimeter;

(b) placing said blasting agent composition contained within said cardboard container underwater;

(c) detonating said blasting agent composition while underwater.

22. The method of underwater detonation as recited in claim 21 wherein the blasting agent composition contains:

(a) from about 75.5% to about 77.5% ammonium nitrate by weight of said composition;

(b) from about 14.0% to about 18.0% water by weight of said composition; and (c) a ratio of wax to oil of about 1:3 by weight.

23. The method of underwater detonation as recited in claim 21 wherein the blasting agent composition contains:

(a) from about 75.76% to about 77.42% ammonium nitrate by weight of said composition;

(b) from about 14.20% to about 17.78% water by weight of said composition;

(c) from about 2.11% to about 3.92% oil by weight of said composition; and (d) a ratio of wax to oil of about 1:3 by weight.

24. The method of underwater detonation as recited in claim 21 further comprising adding up to about 12 parts of an auxiliary fuel per 88 parts of said blasting agent composition during the manufacture of said composition.

25. The method of underwater detonation as recited in claim 21 wherein said detonation occurs under about 30 feet of water.

26. The method of underwater detonation as recited in claim 21 wherein said detonation occurs under about 100 feet of water.

27. The method of underwater detonation as recited in claim 21 wherein said detonation occurs under about 160 feet of water.

* * * * *